United States Patent [19]

Hohmann

[11] Patent Number: 4,598,518

[45] Date of Patent: Jul. 8, 1986

[54] PRONGED VENEER ANCHOR AND DRY WALL CONSTRUCTION SYSTEM

[75] Inventor: Ronald P. Hohmann, Syosset, N.Y.

[73] Assignee: Hohmann Enterprises, Inc., Hauppauge, N.Y.

[21] Appl. No.: 667,414

[22] Filed: Nov. 1, 1984

[51] Int. Cl.[4] ..... E04B 1/38; E04B 1/16

[52] U.S. Cl. ..... 52/410; 52/714

[58] Field of Search ..... 52/410, 712, 713, 714

[56] References Cited

U.S. PATENT DOCUMENTS

| | | | |
|---|---|---|---|
| 2,058,148 | 10/1936 | Hard | 52/714 |
| 2,966,705 | 1/1961 | Massey | 52/714 X |
| 4,021,990 | 5/1977 | Schwalberg | 52/714 X |
| 4,305,239 | 12/1981 | Geraghty | 52/713 |
| 4,438,611 | 3/1984 | Bryant | 52/410 |

FOREIGN PATENT DOCUMENTS

| | | | |
|---|---|---|---|
| 279209 | 3/1952 | Switzerland | 52/714 |
| 2069024 | 8/1981 | United Kingdom | 52/714 |

*Primary Examiner*—J. Karl Bell

*Attorney, Agent, or Firm*—Philip D. Amins

[57] ABSTRACT

A veneer anchor for use in a dry wall construction system which anchor comprises a plate member having a vertically projecting bar portion secured thereto and disposed in substantially parallel relationship with said plate member. The plate member includes end members disposed in substantially perpendicular relationship with respect to said plate member with the end members being bifurcated and having a pronged outer end configuration. The anchor is employed to secure a wall board or insulation layer to a vertical channel or standard framing member and to thereafter maintain the structural integrity of securement of the anchor with respect to the channel or framing member, notwithstanding the ultimate shifting, deterioration or disposition of the wall board or insulation layer. Thereafter, a wall-tie is inserted between the plate member and the projecting bar portion and the wall-tie is built into the outer wythe of the wall system. The wall-tie is capable of vertical adjustability along the length of the projecting bar portion which in conjunction with the plate member concomitantly restricts horizontal movement of the wall-tie.

22 Claims, 3 Drawing Figures

PRONGED VENEER ANCHOR AND DRY WALL CONSTRUCTION SYSTEM

The present invention provides a new and novel veneer anchor construction which is a significant improvement over the original novel anchor construction described in U.S. Pat. No. 4,021,990.

BACKGROUND OF THE INVENTION

While the aforementioned novel anchor construction depicted in U.S. Pat. No. 4,021,990 and designated by the trademark DW-10 ® effectively revolutionized dry wall construction systems which encompassed wall board or insulating layers as a member thereof, the same has not provided the ultimate in structural integrity of the system.

SUMMARY OF THE INVENTION

Accordingly, it is the primary object of the present invention to provide a new and novel veneer anchor construction for use in dry wall systems.

It is another object of the present invention to provide a new and novel veneer anchor for securement of wall board or insulation layer with respect to a channel or standard framing member of an edifice employing a dry wall construction system.

It is a further object of the present invention to provide a new and novel veneer anchor construction to permit of initial placement and securement of a wall board or insulating layer to a channel or framing member.

It is still another object of the present invention to provide a new and novel veneer anchor construction having a plate member which is provided with angularly disposed pronged end members.

It is yet another object of the present invention to provide a new and novel veneer anchor construction of the foregoing type wherein said pronged end members are adapted to initially secure a wall board or insulation layer to the channel or framing member of an edifice.

It is still a further object of the present invention to provide a veneer anchor construction as aforedescribed wherein said pronged end members are bifurcated and abuttingly engage the channel or framing member in order to position said veneer anchor construction with respect thereto.

It is yet a further object of the present invention to provide a veneer anchor and dry wall construction system of the foregoing type wherein a fastener projects through said plate member and in conjunction with said pronged end member provides a triangular type securement of said veneer anchor construction with respect to a channel or framing member.

BRIEF DESCRIPTION OF THE DRAWINGS

The foregoing and other objects, features and advantages of the present invention will become more apparent from the detailed description hereinafter when considered in conjunction with the drawings wherin.

DETAILED DESCRIPTION OF THE PREFERRED EMBODIMENT

Figure 1:
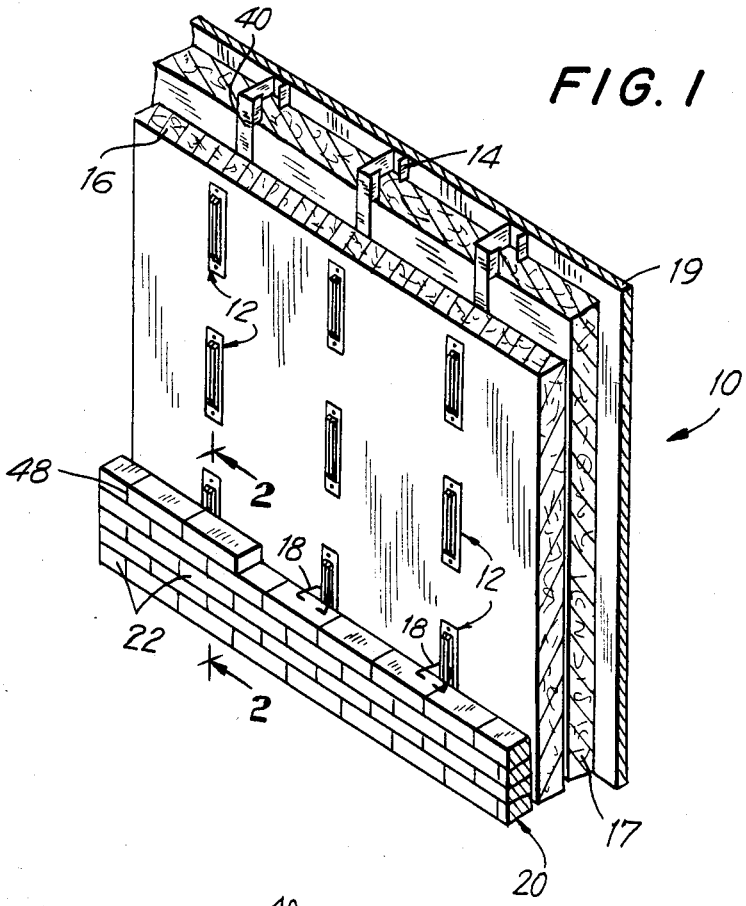
FIG. 1 is a partial perspective view of a dry wall construction system fabricated in accordance with the principles of the present invention and employing the new and novel pronged veneer anchor apparatus thereof.
Figure 3:
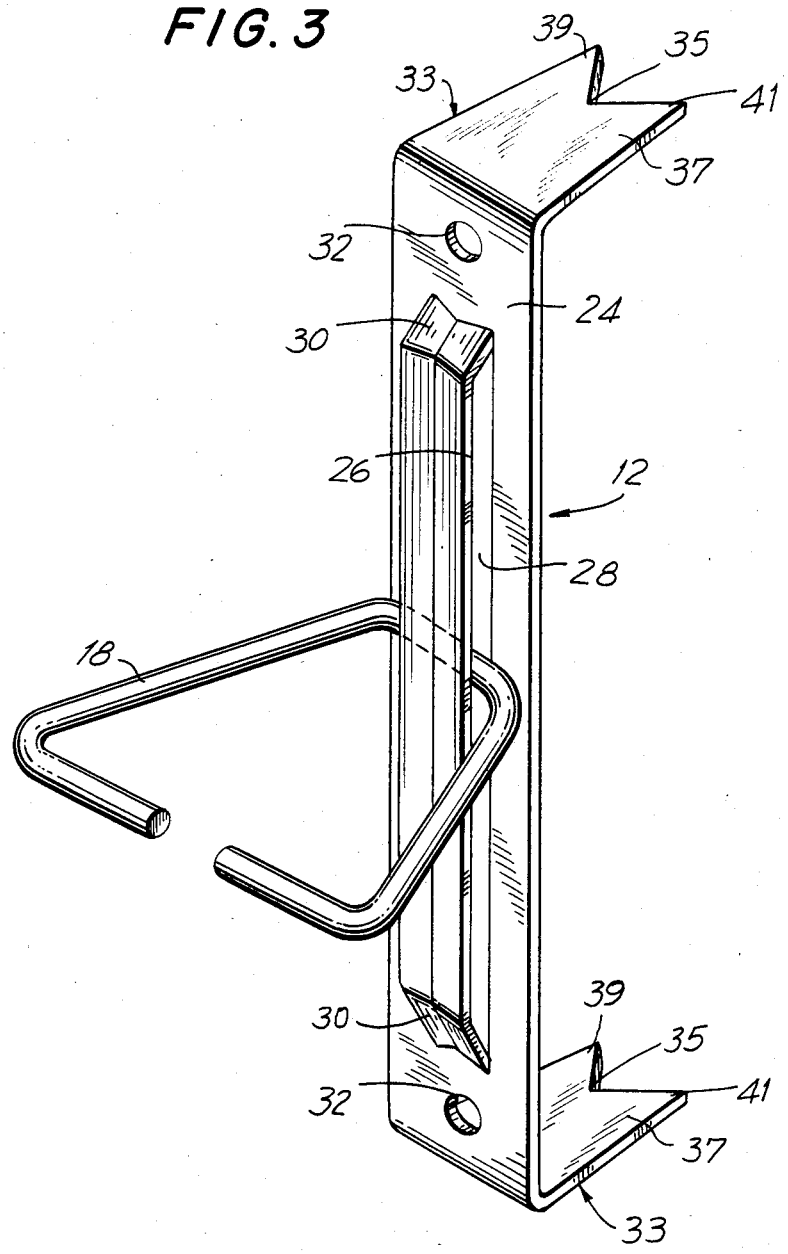
FIG. 3 is a perspective view of the new and novel pronged veneer anchor construction of the present invention depicted in conjunction with a wall tie member.

Referring now to the drawings, and more particularly to FIG. 1 thereof, there is depicted the new and novel dry wall construction system denoted generally by the reference numeral 10 and fabricated in accordance with the principles of the present invention. The construction system 10 employs the new and novel pronged veneer anchor construction generally denoted by the reference numeral 12, as best seen in FIG. 3. The construction system comprises a vertical channel member 14, a wall board 16, the pronged veneer anchor 12, a substantially truncated triangular shaped wall tie 18, also known as a vee-tie, an inner wythe 19, herein depicted as a wall board and an outer wythe, generally designated by the reference numeral 20. The outer wythe is herein illustrated as being constructed of a plurality of individual bricks 22, but, as will be readily apparent to those skilled in the art, may similarily be constructed of cinder blocks or other suitably similar masonry material which have regular or irregular configurations. In a similar manner, the inner wythe 19 may also be constructed of any other similarly suited material. It is also to be noted that the wall board 16 may be replaced by another suitable insulating material which can be positionably disposed between the inner and outer wythes 19 and 20, respectively, within the purview and teachings of the present invention. However, the use of the wall board 16 together with a separate insulating layer 17 is preferred.

Particular reference is now directed to the construction of the pronged veneer anchor 12 comprising a backing plate member 24 and a projecting bar portion 26. The projecting bar portion 26 is punched-out from the central portion of the stock plate member 24 so as to result in a centrally disposed aperture 28 of substantially rectangular configuration being formed in the plate member 24. The projecting bar portion 26 is thus disposed in substantially parallel relationship with respect to the plate member 24; however, the upper and lower ends 30 of the projecting bar portion 26 are slightly angled to permit the full projection of the bar portion 26 with respect to the plate member 24. The plate member is also provided with bores 32 at the upper and lower ends thereof, the purpose and function of which will be discussed in more detail hereinafter. Secured to the upper and lower ends of the plate member 24 in angular substantially perpendicular relationship are end members 33 which are bifurcated as at 35 to thereby form pronged ends 37 defining prong portions or prongs 39 and 41, respectively. Of course, it is within the purview and contemplation of the present invention to have the end members 33 formed with a singular conical prong; however, the bifurcated construction is preferred, so as to provide the ultimate structural integrity herein sought, as will be explained more fully hereinafter.

Figure 2:
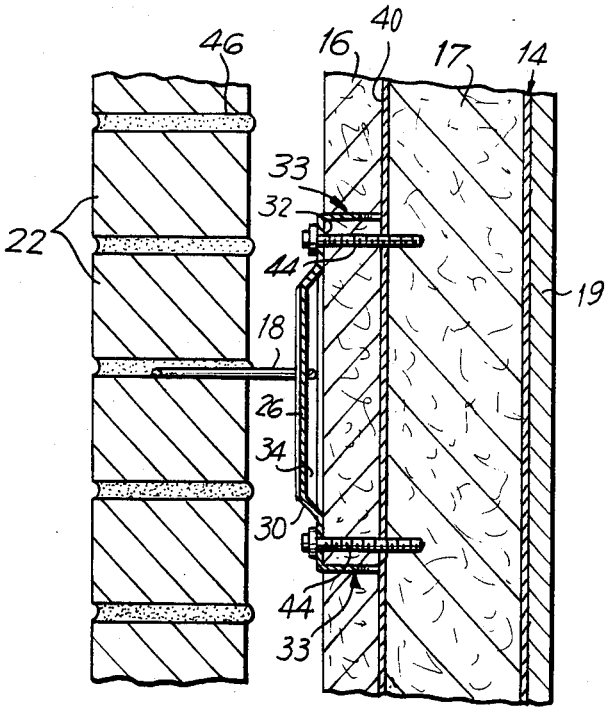
FIG. 2 is a sectional view taken on the line 2—2 of FIG. 1.

As is best seen in FIG. 2, the projecting bar portion 26 is sufficiently spaced from the plate member 24 so as to form a slot 34 therebetween which is adapted to receive the wall-tie 18 therewithin. In the fabrication of the dry wall construction system 10, the channel members 14 are initially secured in place. In this regard, attention is directed to the fact that the members 14 may also comprise the standard framing members of an edifice. The wall board 16 which may be an exterior grade gypsum board is positioned in abutting relationship with the forward flange 40 of the channel member 14. While the insulating layer has herein been described as comprising a gypsum board, it is to be noted that any similarly suited rigid or flexible insulating material may be used herein with substantially equal efficacy. As discussed previously herein, the construction system may include a pliable insulating layer 17 positioned between the wall board 16 and the subsequently constructed inner wythe 19.

After the initial placement of the flexible insulation layer 17 and the wall board 16, the veneer anchors 12 are secured with respect to the front surface 40 of the channel members 14 by a carpenter who forces the prong portions 39 and 41 through the wall board 16 or other insulating layer, until the prong portions abuttingly engage the front flange 40 of the channel members 14, as best seen in FIG. 2. Thereafter, sheet metal screws 44 are inserted into the bores 32 to thereby fasten the anchor 12 with respect to the flange 40 and thus the channel member 14. This completes the preliminary assembly of the dry wall construction system 10 wherein the structural integrity of the securement of the veneer anchor construction 12 with respect to the channel member 14, is assured. It will be readily apparent that the prong portions 39 and 41 in conjunction with the sheet metal screw 44 form a triangular securement configuration with respect to the front flange 40 of the channel member 14, whereby movement of the veneer anchor 12 inwardly with respect to the member 14 is prevented by means of prongs 39 and 41 together with screw 44; and movement outwardly of anchor 12 away from the channel member 14 is precluded by virtue of the securement of the sheet metal screw 44 with the channel member. Subsequently, the mason inserts the wall-ties 18 in the slot 34 formed between the projecting bar portion 26 and the back plate member 24 of each of the veneer anchors 12. Thereafter, fabrication of the outer wythe 20 is commenced utilizing the bricks 22 with the horizontal and vertical joints therebetween being filled with mortar as at 46 and 48, respectively.

The vertical adjustability and the limited horizontal movement of the wall-tie 18 has been described in complete detail in U.S. Pat. No. 4,021,990 and reference is had thereto for further discussion of these features. Attention is directed to the fact that the piercing of the wall board 16 by the pronged end portions 37 has a tendency to create moisture permeation from the outer wythe inwardly through to the inner wythe. Accordingly, the present invention contemplates the provision of a sealant around the area where the pronged portion pierces the wall board 16. Alternatively, the pronged ends 37 may be provided with neoprene washers to thereby prevent any moisture permeation of the pierced portion of the wall board 16.

It will be apparent from the foregoing discussion that the dry wall construction system 10 hereof will retain its structural integrity irrespective of the ultimate decay, deterioration or decimation of the wall board 16 or other similarly disposed insulation layer. In this regard, the wall-tie 18 is prevented from having any appreciable horizontal movement by virtue of the function of the back plate 24 and projecting bar portion 26, while the anchor 12 is prevented from horizontal movement by virtue of the abutting engagement of end members 33 with flange 40 of channel member 14. Specifically, even if one were to completely remove the wall board 16, horizontal movement of anchor 12 with respect to channel member 14 is precluded. Thus, the outer wythe 20 is prevented from moving inwardly should the wall board 16 become dislodged or deteriorate. This ultimate securement of outer wythe 20 with respect to channel members 14 guarantees the structural integrity of the system 10 by preventing premature deterioration of the outer wythe which would otherwise occur, should the same be capable of moving inwardly toward channel members 14 upon the deterioration of the wall board 16 or similarly disposed insulation layer. Of course, the proviso of the insulation layer 17 maintains the barrier between the inner and outer wythes 19 and 20, respectively.

It is thus see that I have provided a new and novel veneer anchor construction in conjunction with a dry wall construction system which obviates problems which may occur or which are of concern in prior art systems and devices. In particular, the triangular securement feature of the anchor with respect to the channel or framing member of an edifice guarantees the structural integrity thereof, and thus of the outer wythe construction; irrespective of the problems of dislodgement or deterioration which may occur to the wall board or other insulation layer in conjunction with which the anchors are secured to said channel or similar members.

While I have shown and described the preferred embodiments of the invention, it will be readily apparent to those skilled in the art that there are changes, modifications and improvements which can be made thereon without departing from the spirit and scope thereof as previously defined and envisioned and as may hereinafter be claimed.

What is claimed is:

1. An improved veneer anchor apparatus for use in conjunction with a support member and comprising a substantially planar plate member having a longitudinal and a lateral dimension, a longitudinally extending bar member having first and second spaced apart ends, means for fixedly securing each of the ends of said bar member to said plate member in a manner whereby said bar member is disposed forwardly of said plate member in substantially parallel relationship therewith, said plate member and said bar member forming a slot therebetween, said plate member including first and second spaced apart end members, said end members being angularly disposed with respect to said plate member, said end members having piercing means on the outer ends thereof, said piercing means being capable of piercingly penetrating wall boards, insulating layers and similar structural materials, said piercing means being disposed in abutting engagement with said support member thereby spacing said plate member a predetermined distance from said support member, and means interconnected between said plate member and said support member for positionally securing said last mentioned members with respect to one another and for preventing any undesirable movement of said veneer anchor apparatus with respect to said support member.

2. A veneer anchor apparatus in accordance with claim 1, wherein
said piercing means comprises
a pronged end portion.

3. A veneer anchor apparatus in accordance with claim 2, wherein
said pronged end portion is of conical configuration.

4. A veneer anchor apparatus in accordance with claim 2, wherein
said pronged end portion is of truncated triangular configuration.

5. A veneer anchor apparatus in accordance with claim 2, wherein
said pronged end portion is bifurcated to form a pair of piercing members.

6. A veneer anchor apparatus in accordance with claim 5, wherein
said piercing members are disposed in coplanar relationship.

7. A veneer anchor apparatus in accordance with claim 2, wherein
said end members are disposed in substantially perpendicular relationship with respect to said plate member.

8. In a veneer anchor assembly for use in conjunction with a support member and having a veneer anchor apparatus, and a wall-tie member, said veneer anchor apparatus comprising
a substantially planar plate member having a longitudinal and a lateral dimension,
a longitudinally extending bar member having first and second spaced apart ends,
means for fixedly securing each of the ends of said bar member to said plate member in a manner whereby said bar member is disposed forwardly of said plate member in substantially parallel relationship therewith,
said plate member and said bar member forming a slot therebetween,
said wall-tie member having one end portion thereof positionally disposed in the slot between said sutstantially parallel plate and projecting bar members of said veneer anchor apparatus,
said end portion of said wall-tie member being capable of longitudinal movement within said slot to enable adjustable positioning of said wall-tie member along the longitudinal extension of said slot,
the improvement comprising
first and second spaced apart end members secured to said plate member,
said end members being angularly disposed with respect to said plate member,
said end members including piercing means on the outer ends thereof, and
said piercing means being capable of piercingly penetrating wall boards, insulating layers and similar structural materials,
said piercing means being disposed in abutting engagement with said support member thereby spacing said plate member a predetermined distance from said support member, and
means interconnected between said plate member and said support member for positionally securing said last mentioned members with respect to one another and for preventing any undesirable movement of said veneer anchor apparatus with respect to said support member.

9. A veneer anchor assembly in accordance with claim 8, wherein
said piercing means comprises
a pronged end portion.

10. A veneer anchor assembly in accordance with claim 9, wherein
said pronged end portion is of conical configuration.

11. A veneer anchor assembly in accordance with claim 9, wherein
said pronged end portion is of truncated triangular configuration.

12. A veneer anchor assembly in accordance with claim 9, wherein
said pronged end portion is bifurcated to form a pair of piercing members.

13. A veneer anchor assembly in accordance with claim 12, wherein
said piercing members are disposed in coplanar relationship.

14. A veneer anchor assembly in accordance with claim 9, wherein
said end members are disposed in substantially perpendicular relationship with respect to said plate member.

15. A dry wall construction system comprising a plurality of support members secured with respect to one another and forming the frame of an edifice,
at least one barrier layer disposed in abutting engagement with the outer surface portion of selective ones of said support members,
at least one veneer anchor disposed in proximate relationship with the front surface of said barrier layer,
said veneer anchor comprising
a plate member,
a projecting bar member, and
end members,
means for fixedly securing said projecting bar member to said plate member in a manner to form a slot therebetween,
means for securing said end members to said plate member in angularly disposed spaced apart relationship,
the rear surface of said plate member being disposed in substantailly parallel proximate relationship with a portion of the front surface of said barrier layer,
means for concomitantly securing said plate member, said barrier layer and a selected one of said support members with respect to one another,
each of said end members having a pronged end portion on the outer end thereof,
said concomitant securement means including said pronged end portions of said end members,
said pronged end portions piercingly penetrating said barrier layer and being disposed in abutting engagement with said outer surface portion of said selective ones of said support members,
said concomitant securement means being effective to prevent any undesirable movement of said veneer anchor with respect to said support member notwithstanding the ultimate disposition or existence of said barrier layer,
a wall-tie member having one end portion thereof positionally disposed in said slot between the plate member and the projecting bar member of said veneer anchor,
an outer wythe assembly, and said wall-tie member being adjustably positionable along the longitudinal dimension of said projecting bar portion within said slot to permit selective positioning and securement of the other end portion of said wall-tie member within said outer wythe assembly.

16. A dry wall construction system in accordance with claim 15, wherein said angular disposition of said end members with respect to said plate member is substantially perpendicular.

17. A dry wall construction system in accordance with claim 15, wherein said concomitant securement means comprises a plurality of bores formed in said plate member, and sheet metal screws being inserted within said bores extending through said barrier layer and threadedly engaging said selected support member.

18. A dry wall construction system in accordance with claim 15, wherein said selected support member comprises a vertical channel member, and said bores comprise at least first and second bores formed in the upper and lower end portions of said plate member, respectively.

19. A dry wall construction system in accordance with claim 15, wherein said pronged end portion has a conical configuration.

20. A dry wall construction system in accordance with claim 15, wherein said pronged end portion has a truncated triangular configuration.

21. A dry wall construction system in accordance with claim 15, wherein said pronged end portion is bifurcated to form a pair of piercing members.

22. A dry wall construction system in accordance with claim 21, wherein said piercing members are disposed in coplanar relationship.

* * * * *